US007464566B2

(12) United States Patent
Rand et al.

(10) Patent No.: US 7,464,566 B2
(45) Date of Patent: Dec. 16, 2008

(54) COOLER UNIT WITH RETAINING CONTROL HOUSING

(75) Inventors: Thomas W. Rand, Cedarburg, WI (US); Andrew J. Doberstein, Hartford, WI (US); Joseph H. Zyduck, Mukwonago, WI (US); Jennifer U. Straszewski, Mequon, WI (US)

(73) Assignee: U-Line Corporation, Milwaukee, WI (US)

( * ) Notice: Subject to any disclaimer, the term of this patent is extended or adjusted under 35 U.S.C. 154(b) by 0 days.

(21) Appl. No.: 11/741,177

(22) Filed: Apr. 27, 2007

(65) Prior Publication Data

US 2007/0251263 A1 Nov. 1, 2007

Related U.S. Application Data

(63) Continuation of application No. 11/681,852, filed on Mar. 5, 2007.

(60) Provisional application No. 60/795,821, filed on Apr. 28, 2006.

(51) Int. Cl.
*F25D 11/00* (2006.01)

(52) U.S. Cl. ..... 62/440; 62/457.3

(58) Field of Classification Search ..... 62/440, 62/331, 371, 457.1, 457.3, 457.4, 457.5, 62/457.7, 457.8, 126, 161, 164, 231; 220/495.03, 220/592.16, 592.17, 592.2, FOR. 124, FOR. 125; 312/36, 45, 72, 401, 405.1, 218
See application file for complete search history.

(56) References Cited

U.S. PATENT DOCUMENTS

| | | | | |
|---|---|---|---|---|
| 2,645,332 | A * | 7/1953 | Martin et al. | 206/545 |
| 4,899,904 | A * | 2/1990 | Dooley et al. | 220/592.16 |
| 6,173,582 | B1 * | 1/2001 | Hixson | 62/457.4 |
| 6,381,966 | B1 * | 5/2002 | Barrow | 62/3.61 |
| 6,401,481 | B2 * | 6/2002 | Hiraoka et al. | 62/407 |
| 6,405,544 | B2 * | 6/2002 | Hiraoka et al. | 62/127 |
| 6,502,408 | B1 * | 1/2003 | Corcoran | 62/63 |
| D482,705 | S | 11/2003 | Reed et al. | |
| 6,658,859 | B2 * | 12/2003 | Phelps et al. | 62/3.6 |
| 6,862,896 | B1 * | 3/2005 | Seidl | 62/457.4 |
| D505,140 | S | 5/2005 | Reed et al. | |
| 6,935,712 | B2 | 8/2005 | Reed et al. | |
| 7,022,283 | B2 * | 4/2006 | McGuire et al. | 422/40 |
| 7,178,343 | B2 * | 2/2007 | Linder | 62/3.6 |

* cited by examiner

*Primary Examiner*—Mohammad M Ali
(74) *Attorney, Agent, or Firm*—Quarles & Brady LLP

(57) ABSTRACT

A cooler unit has a control housing that is mounted to a floor of a cabinet liner that is sloped in a downward direction toward the opening of the cooler unit. The control housing retains consumable items that are stored on the floor of the cabinet liner so that the items do not fall out of the cooler unit. Particularly, the control housing can retain wine bottles. The control housing houses a controller that controls the operation of the cooler unit. The control housing can include a display and user inputs so that a user can easily manage the cooler unit.

10 Claims, 6 Drawing Sheets

COOLER UNIT WITH RETAINING CONTROL HOUSING

CROSS-REFERENCE TO RELATED APPLICATIONS

This application is a continuation of U.S. patent application Ser. No. 11/681,852, filed Mar. 5, 2007, hereby incorporated by reference as is full set forth herein, and this application also claims the benefit of U.S. Provisional patent application Ser. No. 60/795,821, filed on Apr. 28, 2006, and entitled "Control for Cooler Unit," hereby incorporated by reference as if fully set forth herein.

STATEMENT OF FEDERALLY SPONSORED RESEARCH OR DEVELOPMENT

Not applicable.

BACKGROUND OF THE INVENTION

This invention relates to cold storage units, such as coolers and refrigerators, and in particular, the invention relates to cooler units with an improved control unit housings capable of retaining consumable items stored on the liner floors of the cold storage units.

Cold storage units, such as refrigerators, freezers and beverage coolers, are well known, virtually indispensable appliances. Compact refrigerators, especially built-in under-counter beverage and wine coolers, have especially attractive attributes because they can be installed in homes, offices, boats, and recreational vehicles. There has thus been numerous refinements and improvements made to these devices to address and correct deficiencies in the prior art. For example, U.S. Pat. No. 6,935,712, which is herein incorporated by reference, discloses a cooler unit with improved storage and accessibility features.

An issue with compact cooler units is the maximal use of interior space for storage. Such units typically have a liner on the interior of the cabinet with a liner floor that slopes in a downward direction towards the door, either for drainage or because of the draft angle required to remove the liner from the mold. It is sometimes possible to store food and beverage items (i.e., consumable items) on the liner floor; however, the liner floor can prove to be unsuitable for food and beverage item storage because the slope can cause the food and beverage items to rest against the door of the unit when the door is closed. When the door is subsequently opened, the food and beverage items are no longer restrained by the door and can fall out of the cooler unit. Thus, a user is not able to use the liner floor to store food and beverage items, and this available storage space is wasted.

Another problem with retaining is that consumable items stored on the floor of a cooler unit may be disturbed by the door when the door is opened and closed. The jarring of the consumable item can negatively impact the quality of the consumable item. For example, carbonated and sparkling beverages can build up excessive pressure when agitated.

Another issue with compact cooler units is the placement of the controller, display and user inputs. The display should be positioned so that it can be easily viewed and the user inputs should be positioned to be easily accessible. The controller should be positioned to maximize interior space and to protect the control components from excessive heat. These design constraints can be difficult to meet for compact cooler units.

SUMMARY OF THE INVENTION

In one aspect, the present invention provides a cooler unit cabinet defining a storage cavity having a back side an opening at a front side closed by a door. The cooler unit can include a liner disposed in the cabinet, the liner having a bottom wall that may be sloped downward from the rear of the cabinet to the cabinet opening. A control unit housing can be mounted to the liner floor near the cabinet opening. The control unit housing can be configured to retain consumable items stored on the liner floor. The control unit housing can housing a controller that controls the operation of the cooler unit. The control unit housing may further include a display window and user inputs. The consumable items can be beverage items such as wine bottles, which includes sparkling wine bottles. The wine bottles can be stored parallel to the control unit housing and/or perpendicular to the control unit housing.

In another aspect, the present invention provides a control housing having a base wall, a display wall and a retaining wall. The control housing can be attached to a front portion of a bottom wall of the liner and extend across a width of the bottom wall of the liner. The base wall can be positioned adjacent the bottom wall of the liner. The display wall can extend from the base wall. The retaining wall can extend between the display wall and the base wall. The display wall can face the front of the storage cavity and the retaining wall can face the back side of the storage cavity. The retaining wall can include an essentially curved section and an essentially planar section, the essentially curved section extending between the display wall and the planar section and the planar section extending between the curved section and the base wall. The planar section can be essentially perpendicular to the base wall. The display wall can form an angle with the base wall that is between 45 and 90 degrees.

The foregoing and other objects and advantages of the invention will appear from the following description. In this description reference is made to the accompanying drawings which form a part hereof and in which there is shown by way of illustration preferred embodiments of the invention. Such embodiments do not necessarily represent the full scope of the invention, however, and reference must be made therefore to the claims for interpreting the scope of the invention.

DETAILED DESCRIPTION OF THE PREFERRED EMBODIMENTS

Figure 1:
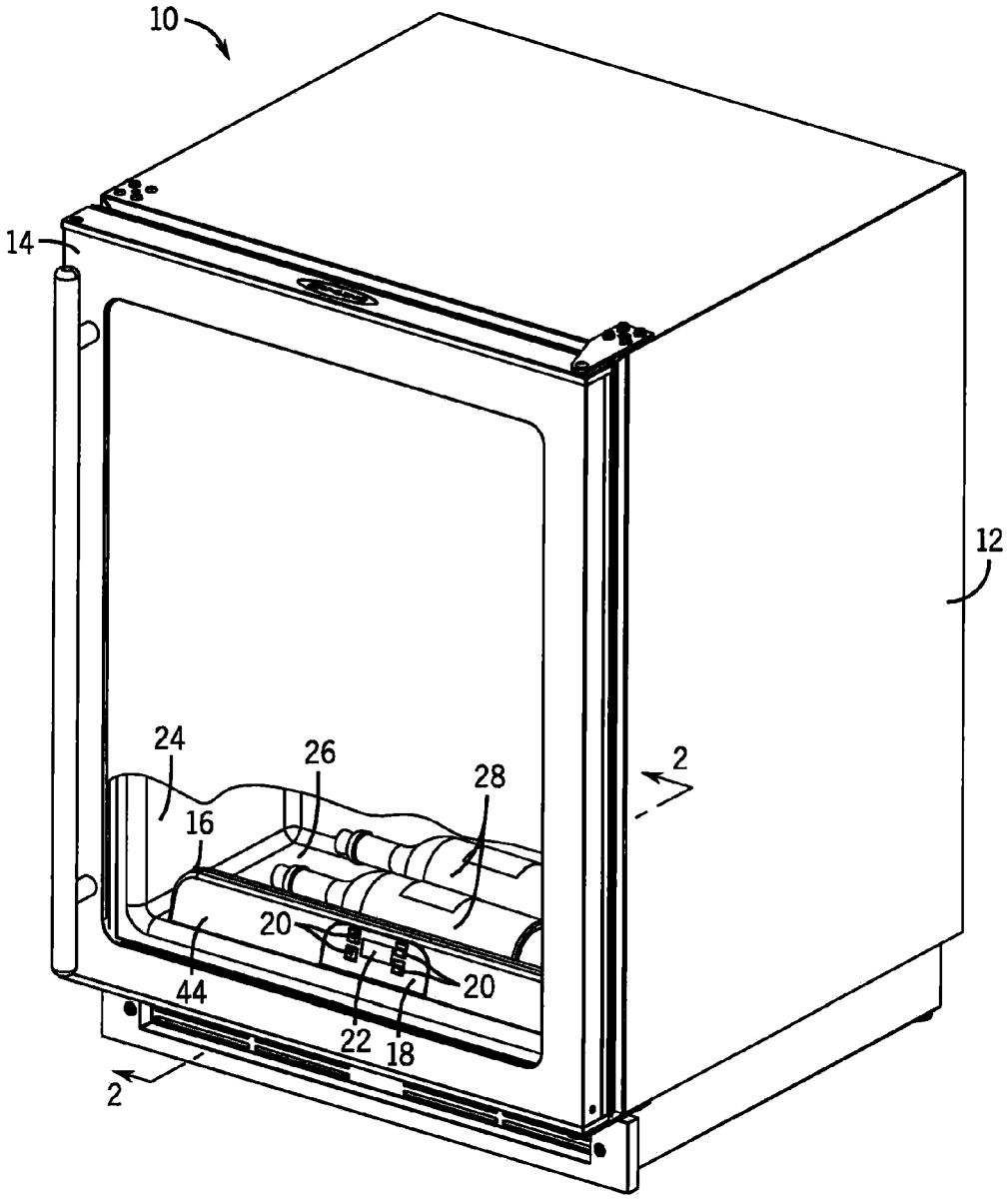
FIG. 1 is a front perspective view of the cooler unit of the present invention with a pair of beverage items stored in a parallel configuration.

FIG. 1 shows a cooler unit 10, the term used herein to mean any self-contained cold storage unit, for example, a refrigerator, freezer, ice maker, a wine and/or beverage cooler, and combinations thereof. The cooler unit 10 generally includes a thermally insulated cabinet 12 defining a storage cavity with an access opening at the front face of the cabinet 12. The opening is sealed by a thermally insulated door 14 pivotally mounted to the front of the cabinet 12. The cooler unit 10 includes a compressor, a capillary tube, and interior and exterior heat exchanger coils containing a standard refrigerant, as known in the art, for lowering the temperature of the air inside the cabinet 12. The compressor and exterior coils are contained in a compartment in the bottom of the cabinet 12 accessible from the back side of the unit (not shown).

A control unit housing 16 contains a control unit comprising a circuit board with a low-voltage portion and a high-voltage portion. The control unit is configured to receive a desired storage cavity air temperature to be maintained from a user input, receive and/or determine the storage cavity air temperature, maintain the storage cavity air temperature at the desired temperature by controlling the cooler unit 10, provide a switch to power an internal light, and provide a switch to power on/off the cooler unit 10. The control unit is electrically coupled to a high-voltage power supply, compressor, and other electrically activated and/or powered components. High-voltage power supply generally means the line-in voltage for a building, such as 110/120 VAC or higher.

An overlay 18 is attached to the control unit housing 16 and includes a plurality of flexible pads 20 and a translucent display window 22. As discussed hereinafter, the pads 20 are associated with switches of the control unit and can include symbols and/or text to indicate with which switch they are associated. The display window 22 may be tinted, colored, and/or treated to otherwise enhance the display. The inside of the cabinet 12 is fit with an insert liner 24 supporting a plurality of shelves (not shown). The control unit housing 16 sits on top of the insert liner floor 26 and is attached to the cabinet 12. The perimeter of the door 14 mounts a flexible magnetic seal typically used with conventional refrigerators. A pair of beverage items 28 are shown placed on the insert liner floor 26 and retained by the control unit housing 16.

Figure 2:
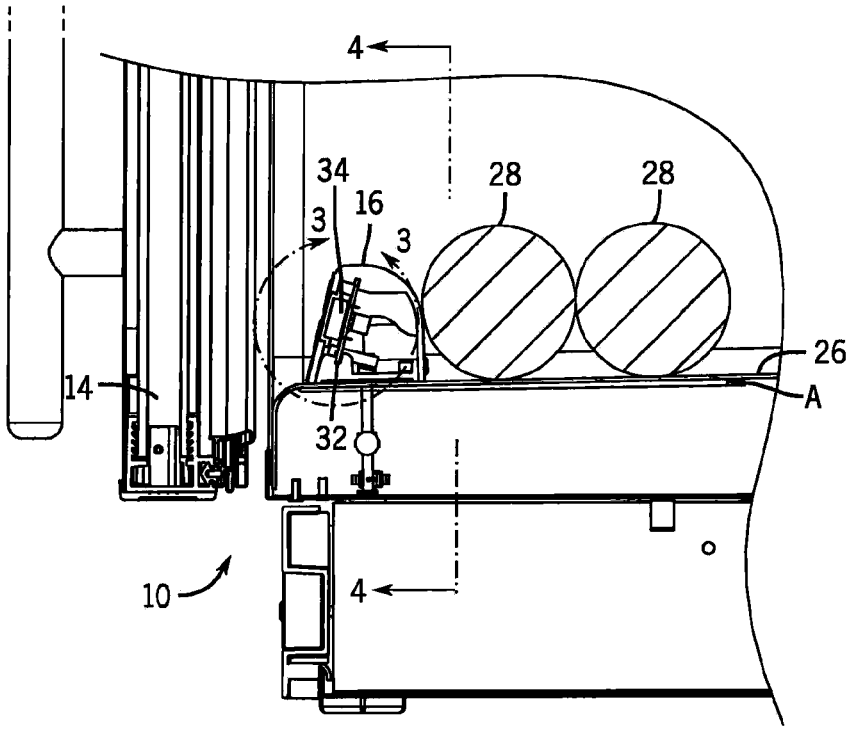
FIG. 2 is a partial side cross-sectional view taken along line 2-2 of FIG. 1.
Figure 3:
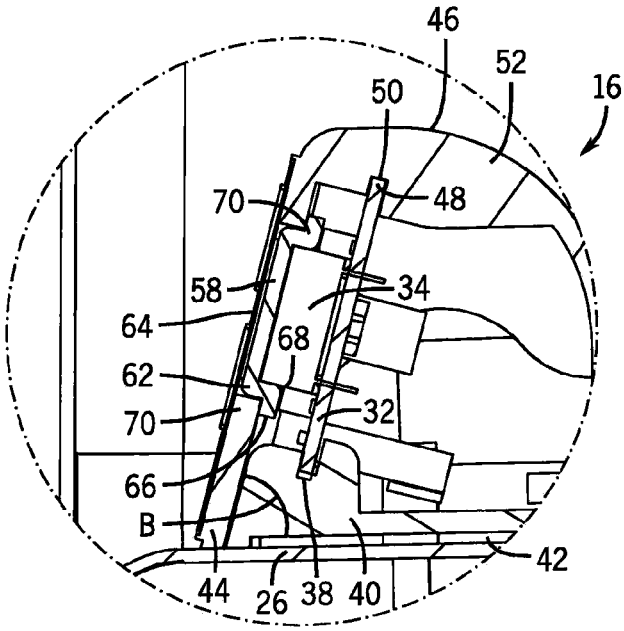
FIG. 3 is an enlarged partial side cross-sectional view within arc 3-3 of FIG. 2.
Figure 4:
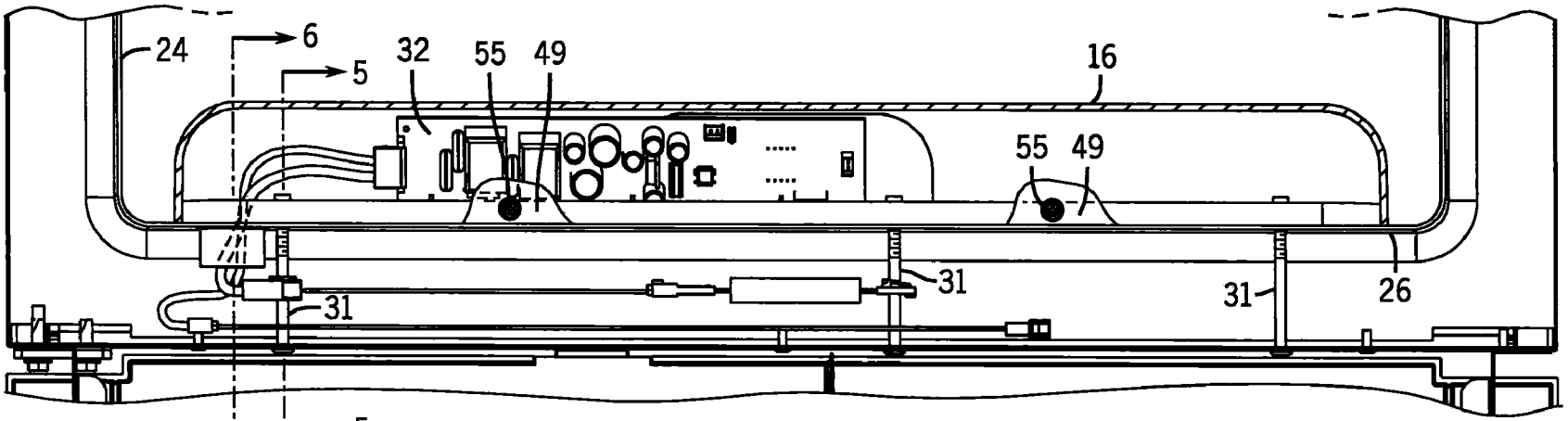
FIG. 4 is a cross-sectional view take along line 4-4 of FIG. 2.
Figure 5:
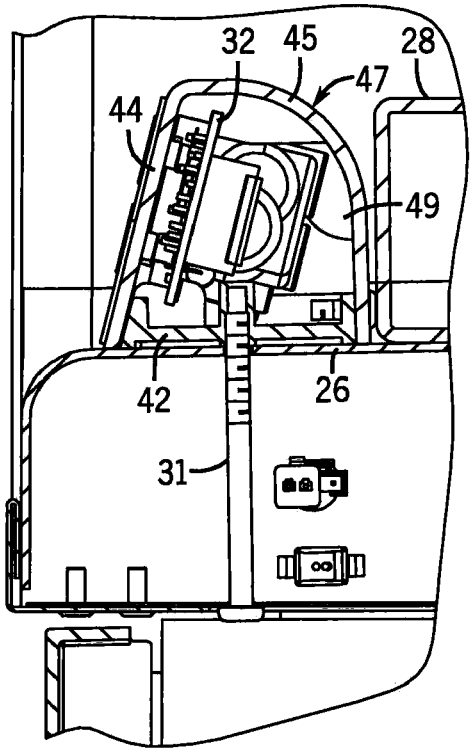
FIG. 5 is a partial side cross-section view taken along line 5-5 of Fig. including a beverage item stored in a perpendicular configuration.
Figure 6:
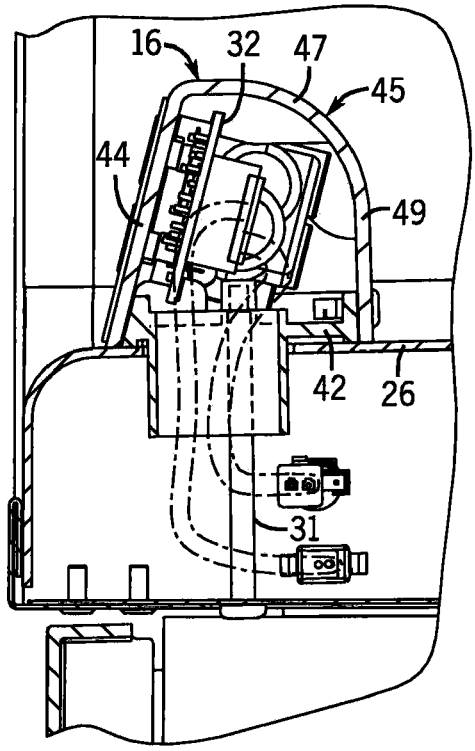
FIG. 6 is a partial side cross-section view taken along line 5-5 of FIG. 4 not including a beverage item.
Figure 7:
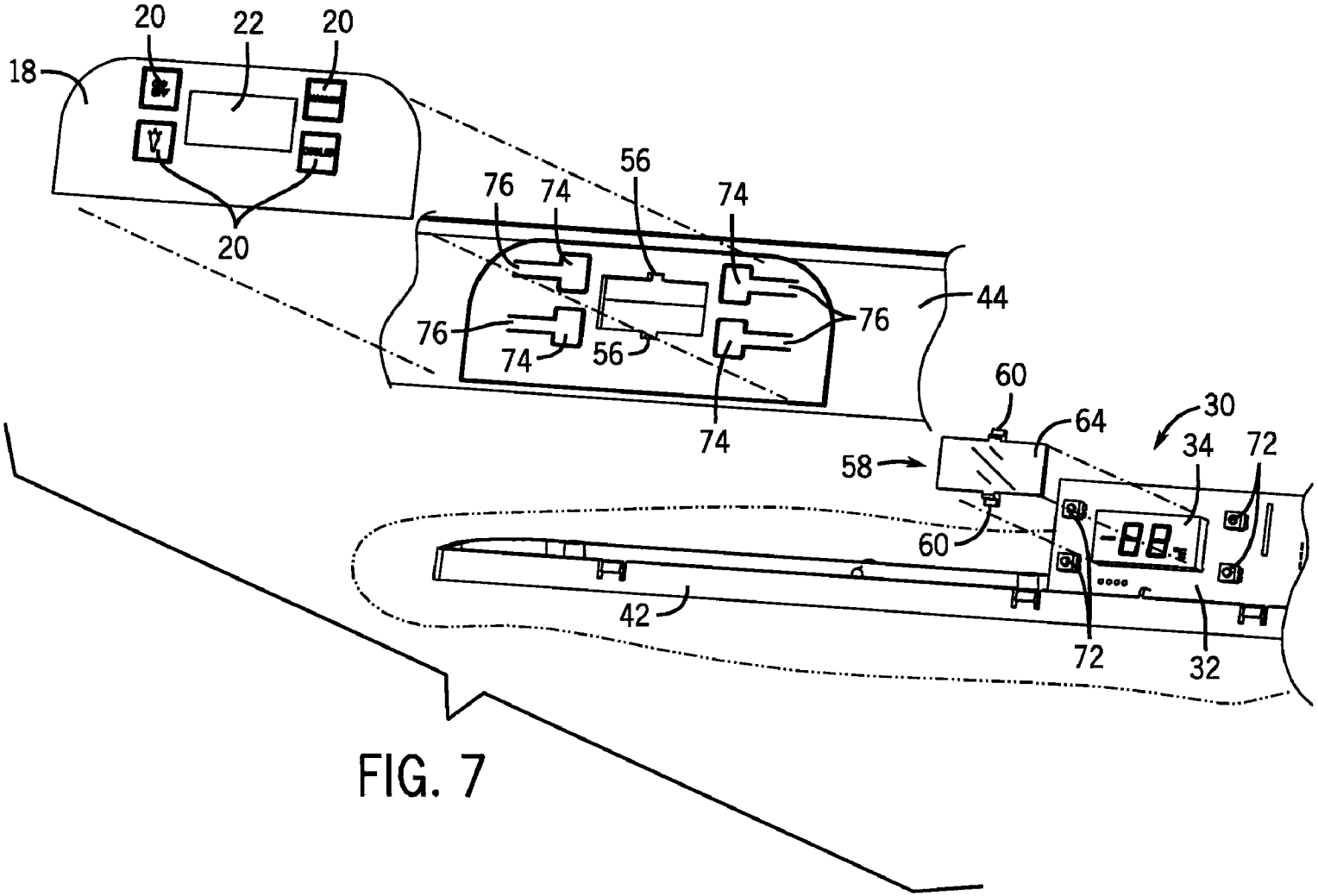
FIG. 7 is a partial exploded assembly view of a base of a control unit housing, a control unit with a display, a display cover, a front face of a control unit housing cover, and an overlay.
Figure 8:
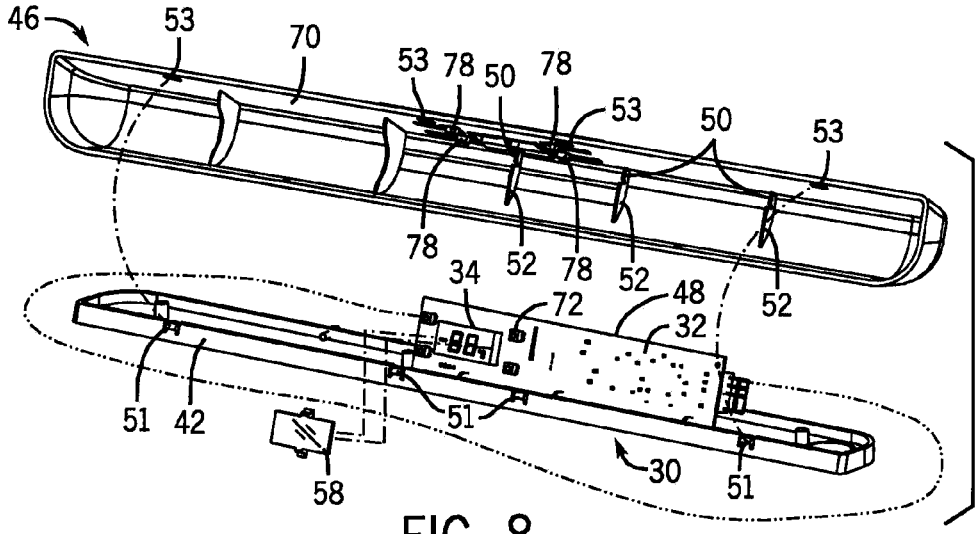
FIG. 8 is an exploded perspective view of the control unit housing and the control unit with the display cover removed, and the control unit housing cover separated from the base and rotated to show a plurality of ribs.
Figure 9:
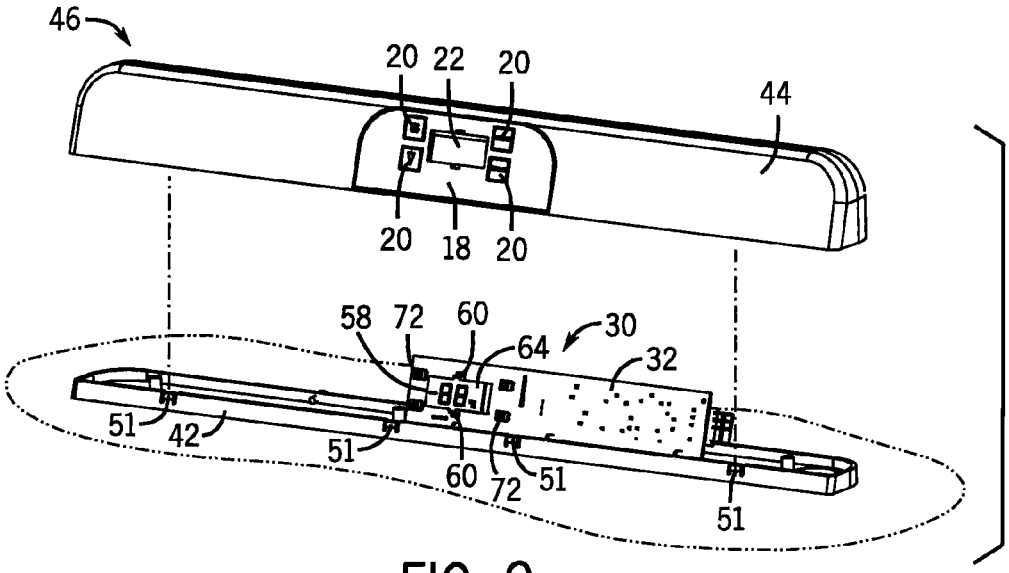
FIG. 9 is an exploded perspective view of the control unit housing of the control unit with the display cover attached to the display, and the control unit housing separated from the base.

Turning now to FIG. 2, control unit housing 16 is configured to maximize storage space in the cabinet 12 and to act as a retainer that prevents the beverage items 28 placed in the bottom of the storage space from exiting the cooler unit 10. The insert liner floor 26 slopes an angle A (A is shown as 1° in FIG. 2) in a downward direction towards the door 14 as a result of the manufacturing process for the liner 24. As is known in the art, an insert liner floor may slope more or less than 1° depending on how the cabinet is configured. The slope can depend on design factors other than the limits/results of the manufacturing process. Beverage and/or food items (i.e., consumable items) placed on the insert liner floor 26 can tend to roll and/or slide downward towards the door 14 and would exit the cooler unit 10 when the door 14 is open if the control unit housing 16 did not stop the items from exiting the unit 10. The beverage items 28 are retained by the control unit housing 16. The control unit housing 16 prevents valuable beverage and food items from falling out of the cooler unit 10 and becoming damaged. The control unit housing 16 also prevents beverage and food items from being disturbed by the door when the door is opened and closed. The floor of the cabinet 12 is typically the coldest area in a cooler unit; accordingly, the control unit housing 16 allows for the storage of food and beverage items. Additionally, the floor of a cooler unit interior may include an angled rack for storing beverage and food items in a semi-upright position, the control unit housing 16 can act as a retainer so that the beverage and food items can be stored in such a position (see FIG. 5).

Referring now to FIGS. 3-9, the control unit housing 16 is attached to the cooling unit 10 by a plurality of fasteners 31. The control unit housing 16 includes a base plate 42 and a housing cover 46. Housing cover 46 includes a front wall 44 and a retaining wall 45, which includes a curved section 47 and a planar section 49. The base plate 42 is positioned on the insert liner floor 26 and is attached to the cooling unit 10 by fasteners 31. Housing cover 46 is attached to base plate 42 with snap-fit connectors 51 extending from base plate 42 that engage snap-fit recesses 53 formed in housing cover 46 (see FIGS. 6 and 7). Additionally, fasteners 55 can be used to attach housing cover 46 to base plate 42 (see FIG. 4). As discussed below, front wall 44 forms an angle with base plate 42 that is less than 90 degrees and planar section 49 is essentially perpendicular to the base plate 42. In an embodiment, the planar section 49 of the retaining wall 45 can have a height greater than a maximum radius of a standard wine bottle and/or a standard sparkling wine bottle. The height of the control unit housing 16 can be less than a maximum diameter of a standard wine bottle and/or standard sparkling wine bottle. In one embodiment, the control unit housing 16 has a height of 1.9 inches.

Besides being aesthetically pleasing, the ramp shape of the retaining wall 45 allows for consumable items, particularly beverage containers, to be carefully placed in and removed from the cooling unit 10. When placing a consumable item on the insert liner floor 26, the consumable item can be gently ramped or rolled down along the retaining wall 45. If a first consumable item is already stored against the retaining wall 45, the ramp shape of the retaining wall 45 allows for a second consumable item to be gently wedged between the retaining wall 45 and the first consumable item. The retaining wall 45 also serves as a ramp that allows for consumable items to be gently removed. Additionally, when a first consumable item rests against the retaining wall 45 and a second consumable item rests against the first consumable item, the ramp shape of the retaining wall 45 allows for the second consumable item to move gradually toward the retaining wall 45 as the first consumable item is removed. This prevents the sudden movement of the second consumable item toward the retaining wall 45, which would result in disturbing the contents of the second consumable item. The shape of the retaining wall 45 can also allow consumable items, especially beverage containers such as wine bottles, to be stacked on the control unit housing 16.

Referring now to FIGS. 3-9, a control unit 30 is mounted to the control unit housing 16. The control unit 30 comprises a printed circuit board 32 with a display 34. The control unit 30 includes a control circuit (not shown) on the printed circuit board 32 comprising various components (not shown) to control the cooler unit 10. The printed circuit board 32 includes the electrical components necessary to receive power from a power supply and condition and/or transform the power to be used by the control circuit and the refrigeration components of the cooler unit 10. The display 34 can be an LCD display, LED display, other conventional display, or an unconventional display configured to provide a visual indication of temperature or other information provided by the control circuit. A bottom edge 36 of the printed circuit board 32 rests in a plurality of slots 38 formed in a plurality of ribs 40 of base plate 42 for the control unit housing 16. The slots 38 are formed in a line that is parallel to front wall 44 of housing cover 46 of the control unit housing 16. A top edge 48 of the printed circuit board 32 fits within a plurality of slots 50 formed in a plurality of ribs 52 of the housing cover 46. The slots 50 are formed in a line that is parallel to the front wall 44. The slots 38 and 50 hold the control unit 30 so that the control unit 30 is parallel to the front wall 44 and so that the circuit board 32 remains a fixed distance from the front wall 44. A display window 54 and a pair of notches 56 are formed within the front wall 44, the notches 56 being disposed on opposite sides of the display window 54. A planar display cover 58 includes a pair of flanges 60, the flanges 60 each having a flange first portion 62 that extends perpendicularly down from a front side 64 of the planar display cover 58 and a flange second portion 66 that extends perpendicularly away from the first portion 62 in a direction that is away from the front face 64. The display cover 58 is sized to overlay the display 34 so that the first portions 62 of the flanges 60 can be friction fitted and/or compression fitted to opposite sidewalls 68 of the display 34. Thus, the display cover 58 is removably attached to the display 34. The display window 54 is sized to fit within the display window 54. The notches 56 formed in the front wall 44 of the housing cover 46 are sized so that the first portions 62 of the flanges 60 of the display cover 58 can fit within the notches 56. The flange second portions 66 of the display cover 58 are configured to engage an inner face 70 of the front wall 44 of the housing cover 46. Thus, the control unit 30 is mounted to the housing 16 in a fixed position. To prevent the control unit 30 from moving within the housing 16, a pair of shallow slots may be formed in the inner face 70 of the front wall 44 of the housing cover 46 where the flange second portions 66 engage the inner face 70 (not shown). Similarly, a portion of the display 34 can extend into the display window 54 so that the sidewalls of the display 34 overlap the sidewalls of the housing front wall 44 that define the display window 56, the sidewalls of the housing front wall 44 blocking the display 34 and thus the control unit 30 from moving (not shown).

To allow a user to view the display 34 when the display is positioned below eye level, the front wall 44 of the control unit housing 16, which is parallel to the display 34, forms an angle B (shown in FIG. 3) with the base plate 42, which is generally parallel to the insert liner floor 26. Angle B can be adjusted depending on at what height the cooling unit 10 will be installed. In an embodiment, angle B can be between 90 and 45 degrees. Alternatively, the angle that the display 34 forms with the control unit housing 16 can be adjusted to allow a user to view the display.

To allow a user to input various commands, the control unit 30 includes a plurality of user inputs. For example, the control unit 30 may allow a user to power on/off the cooler unit 10, control an interior light(s), and input the desired interior air temperature with cooler and warmer switches. In an embodiment of the invention, the control unit 30 includes a plurality of switches 72 that are mounted to the circuit board 32 and in electrical communication with the control circuit of the control unit 30. A plurality of paddles 74 are formed in the front wall 44 of the housing cover 46, the paddles 74 are each connected to the front wall 44 by a living hinge 76 so that the paddles 74 can be pressed and moved towards the inside of the housing cover 46. Each paddle 74 includes a square boss 78 that is positioned adjacent to one of the switches 72 when the control unit 30 is installed in the housing 16. The paddles 74 do not activate the switches 72 unless pressed. Each paddle 74 is associated with an adjacent flexible pad 20 when the overlay 18 is attached to the control unit housing 16. The flexible pads 20 have symbols and/or text on their outward showing faces so that a user may select which pad 20 to press for a desired input command. For example, a light bulb could be printed on a flexible pad 20, the flexible pad 20 associated with a switch 72 that controls the interior light(s). A user presses a selected flexible pad 20 which in turn causes the paddle 74 and its boss 78 to move towards its associated switch 72 thereby depressing the switch 72 and, thus, sending an input command signal to the control unit 30. Once released, the paddle 74 is caused to return to its un-pressed position by the paddle's associated living hinge 76, and the switch 72 is no longer depressed.

The printed circuit board 32 of the control unit 30 may include a combination of high-voltage components, high-power components, low-voltage components, and low-power components. Therefore, various regulations and standards concerning consumer products, such as those developed by Underwriters Laboratories, Inc.®, may require for safety purposes that the circuit board 32 be housed in a structure composed of materials having certain properties (e.g., flame resistance, electrical characteristics, thermal characteristics) and dimensions (e.g., thickness). For example, the housing 16, display cover 58, and paddles 74 may be required to have a certain flame rating with an acceptable range. Additionally, there may be further standards or requirements for the structures positioned nearest to the circuit board 32.

In one embodiment of the invention, the display cover 58 is molded out of Polyone® M4810 RPVC and has a thickness of 2 mm, which gives the display cover 58 an Underwriters Laboratories, Inc.® flame rating of 5 VA or 5 VB. In an embodiment of the invention, the paddles 74, including bosses 78, have a thickness of 5 mm. Furthermore, the housing 16, display cover 58, and paddles 74 can be made of materials that electrically and/or mechanically isolate the circuit board 32 and a display 34 from the control unit housing 16 to prevent injury to a user. The thicknesses of the display cover 58 and paddles 74 may also serve to thermally insulate the display 34 and switches 72, respectively, from an area outside of the display cover 58 and control unit housing 16, respectively.

Illustrative embodiments of the invention have been described in detail for the purpose of disclosing a practical, operative structure whereby the invention may be practiced advantageously. However, the apparatus described is intended to be illustrative only, and the novel characteristics of the invention may be incorporated in other structural forms without departing from the scope of the invention. Accordingly, to apprise the public of the full scope of the invention, the following claims are made:

What is claimed is:

1. A cooler unit having a cabinet defining a storage cavity having a back side and an opening at a front side closed by a door, the cooler unit comprising:

a liner disposed in the cabinet, the liner having a bottom wall sloping downward from the back side to the front side;

a controller for controlling the cooler unit; and a control housing that houses the controller, the control housing comprising a base wall, a display wall and a retaining wall, the control housing attached to a front portion of the bottom wall of the liner and extending across a width of the bottom wall of the liner, the base wall positioned adjacent the bottom wall of the liner, the display wall extending from the base wall, the retaining wall extending between the display wall and the base wall, the display wall facing the front side of the storage cavity and the retaining wall facing the back side of the storage cavity;

wherein the retaining wall is configured to retain at least one consumable item when the consumable item is stored on the bottom wall of the liner and wherein the retaining wall includes an essentially curved section and an essentially planar section, the curved section extending between the display wall and the planar section, the planar section extending from the base wall, the base wall extending between the display wall and the planar section.

2. The cooler unit of claim 1, wherein the control housing includes a display window and the controller includes a display, the display positioned in the display window.

3. The cooler unit of claim 2, wherein the controller includes a user input switch.

4. The cooler unit of claim 3, wherein the control housing includes a movable member positioned proximate the input switch, the movable member configured to transfer force to the input switch.

5. The cooler unit of claim 1, wherein the planar section is essentially perpendicular to the base wall.

6. The cooler unit of claim 5, wherein the display wall forms an angle with the base wall that is less than 90 degrees.

7. The cooler unit of claim 6, wherein the angle is between 45 and 90 degrees.

8. The cooler unit of claim 1, wherein the consumable item is wine contained in a wine bottle.

9. The cooler unit of claim 8, wherein the wine bottle has a maximum diameter and the control housing has a height less than the maximum diameter of the wine bottle.

10. The cooler unit of claim 8, wherein the retaining wall is configured to retain the wine bottle one of when the wine bottle is stored essentially parallel to the control housing and when the wine bottle is stored essentially perpendicular to the control housing.

* * * * *